US012723425B2

(12) United States Patent
Sasakawa

(10) Patent No.: US 12,723,425 B2
(45) Date of Patent: Sep. 1, 2026

(54) FLOATING TYPE COMPREHENSIVE DISASTER PREVENTION WATER-SAVING BUILDING STRUCTURE WITH WATER DAMAGE RESISTANCE

(71) Applicant: TSM CO., LTD., Tokyo (JP)

(72) Inventor: Hiroyuki Sasakawa, Tokyo (JP)

(73) Assignee: TSM Co., Ltd., Tokyo (JP)

( * ) Notice: Subject to any disclaimer, the term of this patent is extended or adjusted under 35 U.S.C. 154(b) by 178 days.

(21) Appl. No.: 18/588,648

(22) Filed: Feb. 27, 2024

(65) Prior Publication Data

US 2024/0191535 A1 Jun. 13, 2024

Related U.S. Application Data

(63) Continuation of application No. PCT/JP2022/032197, filed on Aug. 26, 2022.

(30) Foreign Application Priority Data

Aug. 27, 2021 (JP) ..... 2021-158445

(51) Int. Cl.
*E04H 9/14* (2006.01)

(52) U.S. Cl.
CPC ..... *E04H 9/145* (2013.01)

(58) Field of Classification Search
CPC ..... E04H 9/145; A62C 35/58
See application file for complete search history.

(56) References Cited

U.S. PATENT DOCUMENTS 2,715,756 A * 8/1955 Richard ..... E04H 9/145 52/274
5,775,847 A * 7/1998 Carlinsky ..... E02D 27/32 52/169.9

(Continued)

FOREIGN PATENT DOCUMENTS

JP 2007-192007 8/2007
JP 2017-003215 1/2017

(Continued)

OTHER PUBLICATIONS

International Search Report dated Sep. 27, 2022, of counterpart International Application No. PCT/JP2022/032197, with an English Translation.

(Continued)

*Primary Examiner* — Brian D Mattei
(74) *Attorney, Agent, or Firm* — DLA Piper LLP (US)

(57) ABSTRACT

A sustainable, comprehensive disaster-resistant and water-saving building structure that has a flood-resistant building structure, a seismic isolation structure, a structure that secures water for fire prevention, and a water-saving structure that uses rainwater for water supply. The building structure includes: a building structure that can be moved as a flood-resistant building structure that floats the building structure by using the water reservoir in the lower level of the building as a drainage type buoyancy tank when flood damage due to significant disaster class rainfall is expected to occur. a building structure with seismic isolation function in its movable part when it is raised; a building structure that stores rainwater within the flood scale to realize a building structure with a low center of gravity against earthquakes, securing water for firefighting and fire prevention, and saving water supply through sustainable rainwater utilization; a building structure that uses stored rainwater to cool rooftops and exterior walls with vaporization heat; and a (Continued)

building structure that functions as a detachable lifeboat by using a water tank on the wall to realize efficient transport of multiple people in a rescue operation. Each of the above building structures can be selected and installed as desired.

5 Claims, 2 Drawing Sheets

(56) References Cited

U.S. PATENT DOCUMENTS 5,794,389 A * 8/1998 Vysma ..... E02D 27/32 52/126.5
5,904,446 A * 5/1999 Carlinsky ..... E02D 27/32 52/169.9
5,974,743 A * 11/1999 Vaia ..... E04B 1/34363 52/169.1
6,347,487 B1 * 2/2002 Davis ..... E04H 9/145 52/64
7,793,466 B2 * 9/2010 de Cherance ..... E02D 27/36 52/114
8,066,451 B2 * 11/2011 Ewers ..... E04H 9/14 405/195.1
8,777,519 B1 * 7/2014 Henderson ..... E04H 9/0235 52/167.1
9,238,920 B1 * 1/2016 Carlinsky ..... E02D 31/06
9,637,884 B1 * 5/2017 DeStefano ..... E02D 27/32
10,208,474 B2 * 2/2019 Kelly ..... E04H 9/145
11,613,901 B2 * 3/2023 Kamei ..... E02B 3/10 52/173.1
12,012,770 B2 * 6/2024 Chu ..... B66F 7/20
2014/0157690 A1 * 6/2014 Muroi ..... F24F 5/0035 52/167.4
2015/0247333 A1 * 9/2015 Padtsialezhnikau .... E04H 9/145 114/265
2018/0142461 A1 * 5/2018 Kelly ..... E03B 11/02
2018/0230707 A1 * 8/2018 Parker ..... E02D 27/32
2021/0189741 A1 * 6/2021 Forrest ..... E04H 9/14
2022/0120108 A1 * 4/2022 Harris ..... E04H 9/145

FOREIGN PATENT DOCUMENTS

JP 2017-072016 4/2017
JP 6501961 4/2019
JP 2019-073856 5/2019
JP 2021-001467 1/2021

OTHER PUBLICATIONS

Office Action dated Jul. 4, 2023, of counterpart Japanese Patent Application No. 2021-158445, with an translation.
Office Action dated Jan. 22, 2024, of counterpart Japanese Patent Application No. 2021-158445, with an translation.
Office Action dated Mar. 26, 2026, from counterpart Korean Application No. 10-2024-7010425.

* cited by examiner

【Figure1】
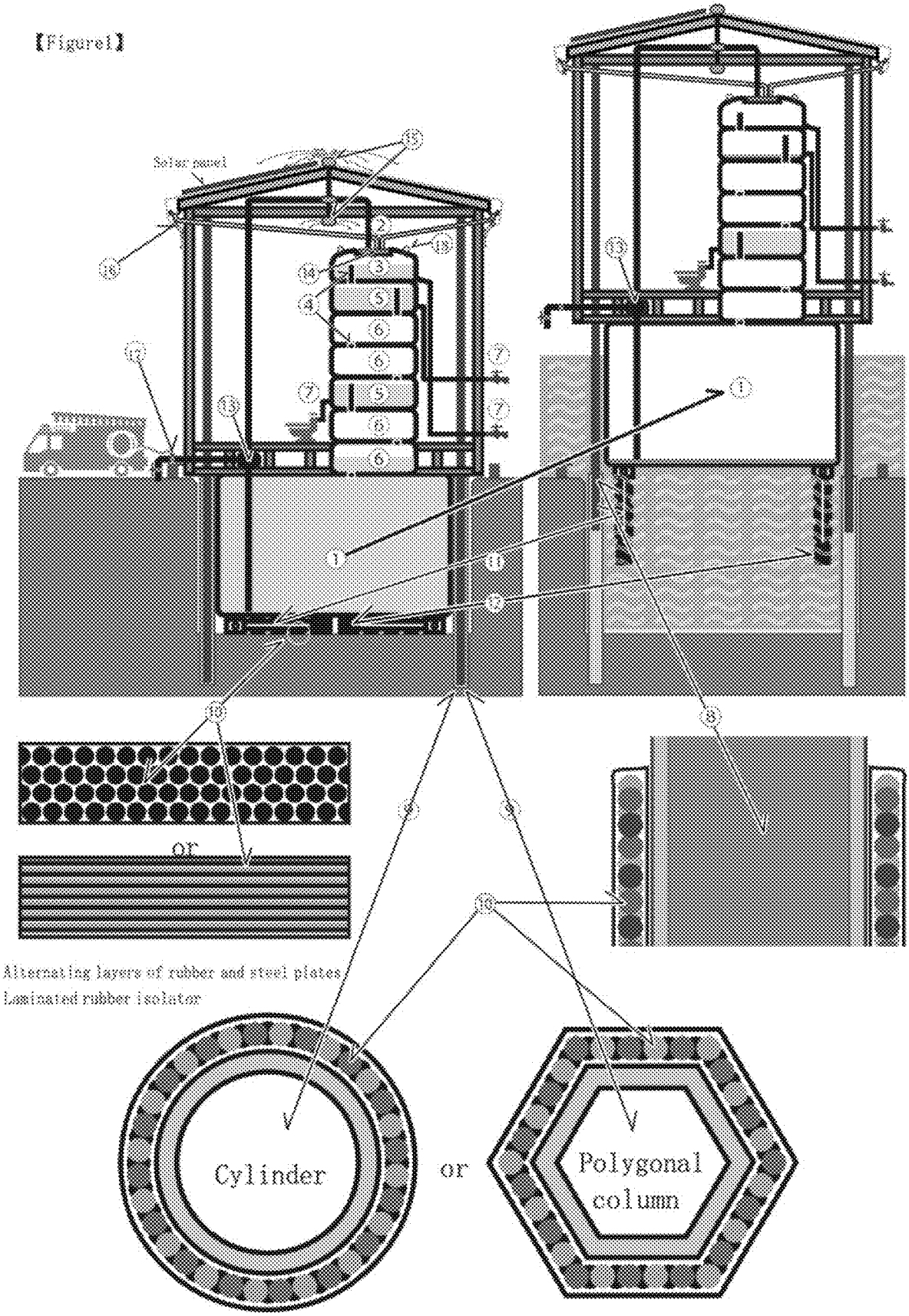

【Figure2】
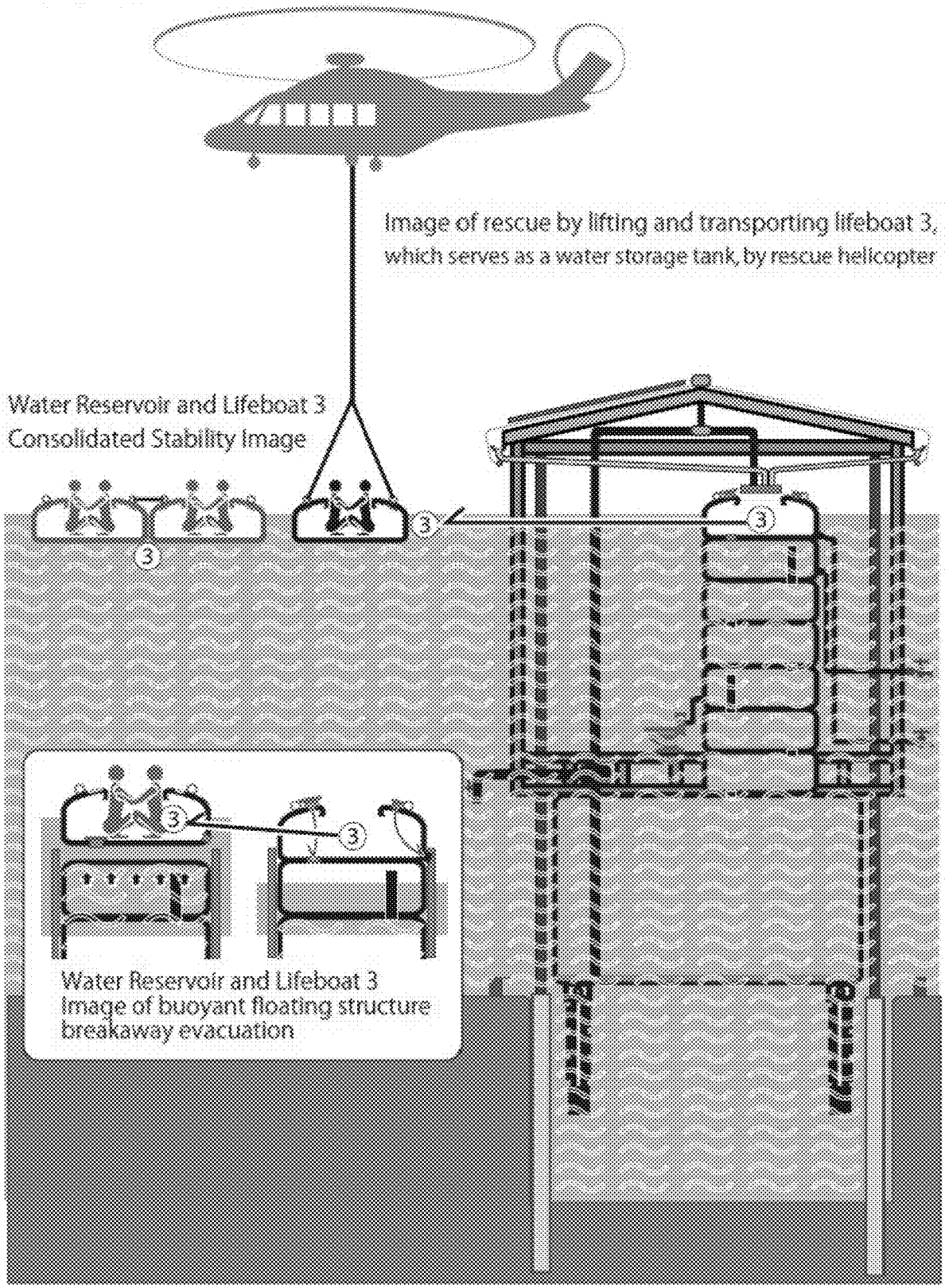

FLOATING TYPE COMPREHENSIVE DISASTER PREVENTION WATER-SAVING BUILDING STRUCTURE WITH WATER DAMAGE RESISTANCE

INCORPORATION BY REFERENCE

This application is a continuation application of International Application No. PCT/JP2022/032197, filed on Aug. 26, 2022, which claims priority of Japanese (JP) Patent Application No. 2021-158445, filed on Aug. 27, 2021, the contents of which are incorporated herein by reference in its entirety.

TECHNICAL FIELD

In addition to the basic structure of the building structure with a low center of gravity by storing rainwater in a drainage-type buoyancy tank on a daily basis and providing seismic isolation functions to the floating and movable parts, the building structure can be made to float by using the water storage tank in the lower level as a drainage-type buoyancy tank during significant heavy rain flooding. The basic structure of the building is provided with a seismic isolation function, and the water stored in the water tanks in the lower level of the building structure is used as water for fire protection and as a firefighting water storage tank to enable firefighting activities during earthquake fires when fire hydrants are not available. Rainwater is sprinkled from fire sprinklers to prevent the building envelope from becoming hotter due to the evaporative cooling effect and to eliminate the scientific weakness of photovoltaic panels, which is the reduction of power generation efficiency due to module temperature rise caused by solar radiation heat. In the event of snowfall, hot water is sprayed from sprinklers to prevent damage caused by snow accumulation on the building. The system is also equipped with a lifeboat for evacuation from flooded areas using a water storage tank and a life-saving tank, contributing to comprehensive community disaster prevention by sharing information with local authorities and supporting evacuation activities.

BACKGROUND

Conventional water-resistant building structures only provide waterproofing technology to prevent water infiltration and do not provide seismic resistance, vibration control, or seismic isolation functions against earthquake disasters.

Structural waterproofing technology with high watertightness can make buildings float in the event of water damage. However, since this structure is specialized for water damage, it is not as convenient or practical in normal times.

In addition, seismic isolation technology is used to reduce earthquake shaking, mitigate resonance in building structures, and reinforce the strength of buildings, but it has made virtually no contribution to disaster prevention against water damage.

Current water and earthquake resistant technologies for building structures are only measures for individual structures and do not contribute to disaster prevention against water damage.

These are merely individual structural measures and do not contribute to comprehensive regional disaster prevention through information sharing with the Meteorological Agency, Ministry of Land, Infrastructure, Transport and Tourism, and local governments such as rainwater harvesting and drainage management and fire prevention water utilization facilities. There was no proposal to equip lifeboats as an integral part of the building structure in the event of an imminent safety emergency for flooding or inundation damage, There is no building structure that contributes to disaster prevention in the form of sustainable water conservation and fire fighting.

In Japanese Patent Publication No. 2017-003215, a system with an under-floor water storage tank and an underground water storage tank is proposed. This system has the function of storing water for drainage in advance when a heavy rain disaster is expected, but its contribution to flood prevention is limited because its main purpose is to save water by using rainwater.

In Japanese Patent Publication No. 2021-001467, a water-resistant structure is proposed to prevent flooding of the living space between the foundation and the foundation of a house in the event of a flood or tsunami. However, this is a technology to prevent flooding of the living space such as inundation above the floor, and not a technology to prevent collapse or structural drift, which is the greatest damage prevention issue for water-resistant building structures.

Japanese Patent No. 6501961 is a technology for preventing flooding of living spaces such as inundation above floor level. JP6501961B is a proposal for a water-resistant building equipped with a waterproof fence that enables long-term evacuation from damage caused by floods and storm surges, but it is not a structure that prevents collapse or structural drift, which is the greatest challenge in preventing damage to water-resistant buildings.

In Japanese Patent Publication No. 2007-192007, it is proposed to house a barge-type building on top of a pool-type foundation of a container structure, which would allow the floating structure to float vertically upward during flooding.

However, this floating structure is not used in any way during normal times. After rising from the pool foundation, this floating structure will be subject to drifting and tossing due to currents and floods. When it drifts, the proposal does not take into account secondary damage such as collision with other structures, or compaction damage and dismantling costs at the drifting destination.

Japanese Patent Publication No. 2017-003215, i.e., Ichijo Corporation, Ichijo Corporation's Flood Resistant Housing: Full-scale Flooding Experiment in 2020, the world's first waterproof house, an under-floor water injection duct system draws water under the floor before the building is lifted up by rising water, providing buoyancy measures.

The building is also waterproofed to prevent flooding and gain buoyancy, and special dampers are used to moor the building to pillars at the four corners of the site to prevent the building from being washed away when the water rises.

In a joint demonstration experiment with the National Research Institute for Earth Science and Disaster Prevention, the mooring building was successfully floated using the world's largest and strongest water sprinkler system and then returned to its original construction site, carning the first Minister of the Environment Award for Global Warming Prevention Activities.

However, they did not envision a situation where debris, driftwood, vehicles, and other debris entered under the floor of a flooded site, making it impossible to maintain a level landing. The proposal was beyond the scope of verification at the experimental facility, which responds only to changes in water levels.

In Japanese Patent Publication No. 2021-001467, i.e., National Research Institute for Architectural and Building Sciences, Housing and Urban Research Group, the Housing and Urban Research Group of the Building Research Institute of the National Institute for Research Advancement (NRIBR) has proposed the following.

The paper proposes a waterproofing plan that includes a cost-effectiveness estimation based on the necessity of flood damage countermeasures in buildings.

However, the plan is limited to minimizing damage from flooding, and the development of flood countermeasures at the urban level is still under consideration.

However, the plan is only designed to minimize damage from flooding.

Japanese Patent No. 6501961, i.e., "Patent Application Technology Trend Survey Report," Planning, Research and Technology Trend Group, General Affairs Department, Japan Patent Office, published in April 2010, reports a survey of patent application technology trends in 2009.

It describes trends in multipurpose anti-vibration, vibration control, and vibration isolation systems, but does not relate them to water damage.

In the field of vibration isolation/vibration-isolation technology, laminated rubber and springs are mentioned, while in the field of vibration control technology, plastic, fluid, and viscoelastic applications are mentioned, However, there are no proposals that address water damage resistance from the perspective of building damage.

It could therefore be helpful to provide structures with excellent water resistance, earthquake resistance, and emergency evacuation in the event of flooding, and to contribute to regional disaster prevention in cooperation with local governments by using water stored in buildings as water for fire prevention and fire extinguishing.

The Law Concerning the Promotion of Rainwater Utilization, enacted by the Ministry of Land, Infrastructure, Transport and Tourism in 1972, aims to optimize the water resource cycle and promote the effective use of water resources by promoting the use of rainwater, as well as to help control the concentrated discharge of rainwater into sewers and rivers.

It is a device to realize this goal and also a device to solve issues common to Goal 6, Goal 11, and Goal 13, as indicated by the international SDGs goals adopted at the UN Summit.

SUMMARY

We thus provide a drained buoyancy tank as a storage tank to be installed at the bottom of the building structure, and the size of the storage tank is determined and installed based on a calculation using Archimedes' principle that an object in a liquid floats with a buoyancy force equal to the weight of the liquid taken out.

In addition to being able to float as a building structure resistant to flood damage, the telescopic and movable support columns also have a seismic isolation function. When there is no danger of flooding, rainwater is stored in the reservoir to lower the structure's center of gravity and improve its seismic resistance.

Furthermore, a fundamental feature of this building structure is that the stored water is used for domestic purposes, and grey water is utilized to achieve sustainable drinking water conservation.

If the water level exceeds the buoyancy of the water-resistant building structure due to unexpected heavy rain or tsunami, the stored rainwater is used under normal circumstances, but in an emergency, water storage tanks and lifeboats installed in upper-floor rooms, attics, and walls of the building structure are used as evacuation lifeboats with the function of helping vertical evacuees escape. These tanks and lifeboats can be used as comprehensive disaster prevention and water-saving building structures for saving lives.

Item 1. A sustainable, comprehensive disaster-resistant and water-saving building structure that has a flood-resistant building structure, a seismic isolation structure, a structure that secures water for fire prevention, and a water-saving structure that uses rainwater for water supply, comprising:

a building structure that can be moved as a flood-resistant building structure that floats the building structure by using the water reservoir in the lower level of the building as a drainage type buoyancy tank when flood damage due to significant disaster class rainfall is expected to occur.

a building structure with seismic isolation function in its movable part when it is raised;

a building structure that stores rainwater within the flood scale to realize a building structure with a low center of gravity against earthquakes, securing water for firefighting and fire prevention, and saving water supply through sustainable rainwater utilization;

a building structure that uses stored rainwater to cool rooftops and exterior walls with vaporization heat; and a building structure that functions as a detachable lifeboat by using a water tank on the wall to realize efficient transport of multiple people in a rescue operation, wherein each of the above building structures can be selected and installed as desired.

Item 2. The comprehensive disaster-resistant and water-saving building structure according to item 1, further comprising individual building structures that contribute to comprehensive regional disaster prevention and are linked to the government's flood control management plan and have a comprehensive regional disaster prevention facility building structure that can implement individual storage or regional planned drainage discharge in conjunction with the government's heavy rainfall countermeasure plan.

Item 3. The comprehensive disaster-resistant and water-saving building structure according to item 1, allowing:

local water pressure by location energy of water storage facilities in the comprehensive disaster prevention water-saving building structure with the function of securing a water source for initial firefighting when fire water tanks and fire hydrants cannot function due to obstructions caused by debris deposited by flooding;

water sprinkler function for firefighting; and voluntary initial firefighting when roads are cut off by earthquakes and firefighting organizations are unable to reach the site.

Item 4. The comprehensive disaster-resistant and water-saving building structure according to item 1, further comprising functions of:

using the water sprinkler function of the fire sprinklers, embodying evaporative heat cooling by rainwater discharge, which solves the problems of chalky water, chlorine content, and calcium solidification adhesion caused by water from the tap to the crystalline silicon solar panels, which are the most widespread type of solar panels in solar power generation, and preventing significant drop in voltage due to the rise in panel temperature and improves power generation efficiency while reducing the rise in room temperature. Furthermore, during the snowfall season, heated water is sprayed from the aforementioned water sprinkler system for firefighting to prevent snow damage to building structures.

Item 5. The comprehensive disaster-resistant and water-saving building structure according to item 1, the building structure responds immediately to the occurrence of a disaster that cannot be avoided by vertical evacuation in flood-resistant building structures when the water level rises due to unexpected flooding, and allows the water reservoir functions as a detachable lifeboat to ensure stability by connecting multiple reservoirs and lifeboats and to realize efficient transport of multiple people in a rescue operation.

Our structure can prevent flood damage by draining rainwater from a water reservoir under the building structure in advance according to the expected rainfall, securing buoyancy as a buoyancy tank, and levitating the building structure.

By having the seismic isolation function in the extending columns as supports that levitate the building structure, and by levitating the building structure in place, the building structure will be resistant to flooding damage and have seismic isolation functions that can respond to unpredictable earthquakes.

When water is stored in the lower part of the structure, except when heavy rain is expected, the earthquake resistance of the structure can be improved by lowering the center of gravity of the lower part of the structure.

By using the stored water for fire prevention and fire extinguishing, the structure can be realized as a basic structure for comprehensive disaster prevention and water-saving architecture.

In addition, water from the water storage tank, which can be used as water for fire prevention and fire extinguishing, can also be used to cool photovoltaic panels, thereby improving the efficiency of power generation.

Furthermore, the water storage and drainage functions of cisterns and lifesaving tanks installed at the bottom of building structures, on rooftops, in attics, and on walls can be used to save water by reusing rainwater on a daily basis.

Although the water storage and drainage functions are activated when heavy rain or tsunami warnings are issued, reusing rainwater on a daily basis can help conserve drinking water and increase power generation efficiency by using it as cooling water for solar panels.

When heavy rainfall is expected or a tsunami warning is issued, the building can be used as a water-saving building that contributes to comprehensive disaster prevention, including participation in flood control through rainwater storage and planned drainage based on water volume management, in cooperation with the Japan Meteorological Agency, Ministry of Land, Infrastructure, Transport and Tourism, and local governments.

The number of heavy rainfall disasters that exceed national flood control targets is increasing.

Under these circumstances, measures to improve the storage capacity of comprehensive disaster prevention and water-saving building structures that do not involve land acquisition will help reduce flood damage and ensure storage of water for fire prevention.

Another important industry development issue is the realization of strategies to share disaster prevention technologies with foreign countries.

By sharing disaster prevention facility plans and data, a monitoring system that can make a significant contribution to flood damage reduction and the protection and rescue of human life can be realized both industrially and economically.

BRIEF DESCRIPTION OF THE DRAWINGS

Features, advantages, and technical and industrial significance of examples will be described below with reference to the accompanying drawings, in which like numerals denote like elements.

FIG. 1 is a schematic diagram showing the outline of the floating structure of a building structure resistant to flood damage; and FIG. 2 is an image of a lifeboat at the time of flood damage evacuation by levitation and detachment of the water reservoir cum life-saving tank of this example.

DETAILED DESCRIPTION

The following is an overview of this form of comprehensive disaster prevention and water conservation building structure with reference to the figures.

This form of floating building structure for flood prevention not only prevents water from entering the building structure and prevents flood damage resistance, but also provides a system of cisterns and wall cisterns as a sustainable rainwater reuse facility.

Cisterns and wall cisterns are not only used for rainwater storage and planned drainage in collaboration with the government based on flooding risk forecasts, but also provide structures that realize a float function as a source of buoyancy for building structures.

FIG. 1 shows one example, a comprehensive disaster-resistant, water-saving building structure floating structure. In this water-resistant building structure floating structure, a water storage floating tank 1 that can be drained as a water storage tank is installed at the bottom of the building structure, and rainwater is stored or drained in advance according to the forecast of heavy rain or tsunami warning to ensure the building structure's floating function as a source of buoyancy.

Rainwater collected from roofs and rooftops by rainwater storage guide pipes 2 is stored in wall water storage tank cum lifeboat 3, wall rainwater storage tank cum living water tank 5, and auxiliary tank 6 for increasing wall rainwater storage volume, and then stored in water storage buoyancy tank 1 that can drain via connecting pipes 4 for adjusting the water level in the storage tank.

Rainwater guided by the rainwater storage guiding pipe 2 can be stored in the draining water storage buoyancy tank 1 without any or all of the wall surface water storage tank cum lifeboat 3, wall surface rainwater storage tank 5 for domestic water, and auxiliary tank 6 for increasing wall surface rainwater storage volume, and can function without problems as a floating structure of a building structure resistant to flood damage.

The main function of the building structure levitating structure is to levitate the building structure by using a drainable water storage buoyancy tank 1 in a water-saving building structure for disaster prevention, but to supply drinking and domestic water in the event of flooding, a wall surface water storage tank cum lifeboat 3, wall surface rainwater storage tank 5. Wall surface rainwater storage increase auxiliary Tank 6 can be connected with water level adjustable connecting pipe 4, the length of the connecting pipe can be set and changed as desired to ensure any desired amount of water, and a water purifier or filtration system can be installed as desired in front of the water intake terminal to ensure the required water quality level.

Rainwater from wall cistern 3 and lifeboat 5 can be used for toilet drainage, make-up water for bathtubs, water for washing dishes, water for cleaning vehicles and other tools, water for sprinkling water on plants and the like by installing any water purifier or filtration device in front of the intake terminal to control water quality, thereby achieving sustainable water conservation in the water supply. It can also contribute to the reduction of carbon dioxide emissions.

In the integrated water-saving building structure for disaster prevention, even during daily drought, the pump 13 for lifting and draining is activated to secure the amount of water for rainwater use, and water is lifted from the drainable water storage buoyancy tank 1 to the wall surface water storage tank and lifeboat 3, and supplied to the wall surface water storage tank and lifeboat 3 and wall rainwater storage tank 5 to realize sustainable water supply water saving in the water supply system. The water is pumped to the lifeboat 3, and supplied to the wall water storage tank and lifeboat 3, and the wall rainwater harvesting tank 5.

The pump 13 for pumping water can be operated as desired to pump water from the buoyancy tank 1 for water storage to the fire sprinkler system 15 and the water conduit 16 for cooling the heat of vaporization on the exterior walls. The rainwater sprinkler system can significantly improve power generation efficiency by cooling the vaporization heat of the solar cell modules. The system also contributes to temperature control inside the building, and by sprinkling warm water, damage caused by snow accumulation can be prevented. Of course, the installation of fire sprinkler equipment (15) and water pipes (16) for evaporative cooling water from exterior walls are optional, and operation and water pressure can be adjusted as desired.

The number of self-supporting legs (11) stored in the bottom of the floating tank, the height of the self-supporting legs, and whether or not the self-supporting legs are installed are of course optional, and instead of installing self-supporting legs, laminated seismic isolation material can be optionally installed at the bottom of the floating tank 1 for wastewater storage. The auxiliary tank 6 for increasing rainwater storage volume can be replaced with the wall rainwater storage tank 5 as appropriate. The shape, capacity, and quantity of the floating water tank 1 for wastewater storage, the floating water tank cum lifeboat 3 for wall surface storage, the auxiliary tank 5 for using wall surface rainwater as domestic water, and the auxiliary tank 6 for increasing rainwater storage volume can be changed as needed according to the scale of the building structure to withstand flood damage. In the schematic diagram, the exterior wall columns of the structure and the columns 8 that extend when the structure is raised are shown separately, but they may naturally be the same.

In the above comprehensive water-saving building structure for disaster prevention, the applicable materials of the water storage buoyancy tank 1, wall water storage tank cum lifeboat 3, wall rainwater storage living tank 5, and rainwater storage increase auxiliary tank 6, which can be drained, are not specified, and the forming materials of the water storage buoyancy tank 1 and the like, which can drain, may be lightweight concrete molded waterproof structure and the like.

In the schematic diagram showing the outline of the comprehensive disaster prevention and water conservation building structure, the drainable water storage buoyancy tank 1 supports the entire upper level of the building structure in an integrated structure.

However, it is assumed that the number of buoyancy lifting struts 8 will be configured and arranged according to the number and position required to balance the upper level of the building structure.

If the pumping capacity of the pump 13 for both pumping and draining does not reach the pumping capacity for fire extinguishing, it is naturally possible to directly connect the water supply outlet for fire extinguishing to the water storage tank 1, and the installation of the water supply system can be freely selected according to the pump output capacity.

In the schematic shown in FIG. 1, the water storage/rescue tank 3 is shown on the seventh level of the wall cistern, but this can naturally be changed according to the conditions of individual building structures.

In addition to the attachment and removal shown in the structure attachment and removal evacuation diagram, it is also possible to use by attachment and removal by human power or other means, or to install the life-saving tanks in separate sections depending on the size to be transported.

It is naturally possible and recommended to supplement the waterproof packing, etc. to stop the water after removing the water level connecting pipe 4 and rainwater domestic water faucet 7 shown in the evacuation diagram of the water storage tank cum lifeboat 3 by buoyancy surfacing with a structure with a backflow prevention valve on the connecting pipe and water intake.

What is claimed is:

1. A sustainable, comprehensive disaster-resistant and water-saving building structure comprising:

a water reservoir disposed in a lower level of the building and configured to function as a drainage type buoyancy tank that floats the building structure when flood damage due to significant disaster class rainfall is expected to occur;

a movable support structure having a seismic isolation function when the building structure is raised;

a rainwater storage system configured to store rainwater within a flood scale to lower a center of gravity of the building structure against earthquakes, to secure water for firefighting and fire prevention, and to save water supply through sustainable rainwater utilization;

a cooling system configured to use stored rainwater to cool rooftops and exterior walls with vaporization heat; and a water tank disposed on a wall of the building structure and configured to function as a detachable lifeboat to realize efficient transport of multiple people in a rescue operation.

2. The comprehensive disaster-resistant and water-saving building structure according to claim 1, wherein the rainwater storage system is configured to implement individual storage or regional planned drainage discharge in conjunction with a government's heavy rainfall countermeasure plan to contribute to comprehensive regional disaster prevention.

3. The comprehensive disaster-resistant and water-saving building structure according to claim 1, further comprising a water supply system configured to provide local water pressure by location energy of the rainwater storage system to secure a water source for initial firefighting when fire water tanks and fire hydrants cannot function due to obstructions caused by debris deposited by flooding, and to provide a water sprinkler function for firefighting and voluntary initial firefighting when roads are cut off by earthquakes.

4. The comprehensive disaster-resistant and water-saving building structure according to claim 1, further comprising fire sprinklers having a water sprinkler function configured to embody evaporative heat cooling by rainwater discharge to crystalline silicon solar panels to prevent significant drop in voltage due to rise in panel temperature and to improve power generation efficiency while reducing rise in room temperature, and wherein during a snowfall season, heated water is sprayed from the fire sprinklers to prevent snow damage to the building structure.

5. The comprehensive disaster-resistant and water-saving building structure according to claim 1, wherein the water tank is configured to respond immediately to occurrence of a disaster that cannot be avoided by vertical evacuation when a water level rises due to unexpected flooding, and wherein the water tank functions as the detachable lifeboat and is configured to connect with multiple reservoirs and lifeboats to ensure stability and to realize efficient transport of multiple people in a rescue operation.

* * * * *